United States Patent [19]

Ariyama et al.

[11] 4,411,511

[45] Oct. 25, 1983

[54] IMAGE TRANSFER MATERIAL SEPARATION AND TRANSPORTATION APPARATUS FOR ELECTROPHOTOGRAPHIC COPYING APPARATUS

[75] Inventors: Kenzo Ariyama, Yokohama; Akira Hirose, Tokyo, both of Japan

[73] Assignee: Ricoh Company, Ltd., Japan

[21] Appl. No.: 219,258

[22] Filed: Dec. 22, 1980

Related U.S. Application Data

[63] Continuation-in-part of Ser. No. 213,650, Dec. 5, 1980, abandoned.

[30] Foreign Application Priority Data

| | | | |
|---|---|---|---|
| Dec. 20, 1979 | [JP] | Japan | 54-165920 |
| Jan. 22, 1980 | [JP] | Japan | 55-006392[U] |
| Jan. 25, 1980 | [JP] | Japan | 55-007590 |

[51] Int. Cl.[3] ..... G03G 15/14; G03G 15/22

[52] U.S. Cl. ..... 355/3 TR; 271/307; 271/311; 271/DIG. 2; 355/3 SH

[58] Field of Search ..... 355/3 R, 3 TR, 3 SH, 355/3 TE, 14 SH, 14 TR; 271/307, 308, 310, 311, 312, DIG. 2

[56] References Cited

U.S. PATENT DOCUMENTS

| | | | |
|---|---|---|---|
| 3,684,363 | 8/1972 | Ito et al. | 355/3 R |
| 3,687,539 | 8/1972 | Furuichi | 355/3 R X |
| 3,743,406 | 7/1973 | Komori et al. | 355/14 SH X |
| 3,955,889 | 5/1976 | Ishiguro et al. | 355/3 R |
| 4,000,942 | 1/1977 | Ito et al. | 355/3 R |
| 4,060,230 | 11/1977 | Church et al. | 271/312 |
| 4,114,536 | 9/1978 | Kaneko et al. | 355/3 TE X |
| 4,269,504 | 5/1981 | Landa | 355/3 SH |
| 4,278,341 | 7/1981 | Burgess et al. | 355/3 SH |
| 4,327,991 | 5/1982 | Takeuchi et al. | 355/3 SH |

*Primary Examiner*—Fred L. Braun

*Attorney, Agent, or Firm*—Guy W. Shoup; Eliot S. Gerber

[57] ABSTRACT

In an electrophotographic copying apparatus of the type utilizing a photoconductor which is rotated in a predetermined direction with an image transfer material in close contact therewith for transferring an electrostatic latent image or a visible image formed on the surface of the photoconductor to the image transfer material, an image transfer material separation and transportation apparatus capable of separating the image transfer material to which the image has been transported from the surface of the photoconductor and transporting the same in the direction of the photoconductor. One leading edge corner of the image transfer material is bent by a corner bending apparatus before the image transfer material is brought into close contact with the surface of the photoconductor. The bent corner is small in area and is formed in such a manner as to be turned up from the surface of the photoconductor by an image transfer material catching and separation member which is disposed in contact with or in close proximity to the surface of the photoconductor drum, and is very effective for leading the image transfer material into the image transfer material separation and transportation apparatus. The image transfer material separation and transportation apparatus has at least two rotating members which are capable of holding the image transfer material therebetween and separating the same from the surface of the photoconductor.

71 Claims, 32 Drawing Figures

IMAGE TRANSFER MATERIAL SEPARATION AND TRANSPORTATION APPARATUS FOR ELECTROPHOTOGRAPHIC COPYING APPARATUS

This application is a continuation-in-part application based in part upon the application Ser. No. 213,650, filed Dec. 5, 1980, now abandoned, entitled "Image Transfer Material Separation and Transportation Apparatus For Electrophotographic Copying Apparatus."

BACKGROUND OF THE INVENTION

The present invention relates to an image transfer material separation and transportation apparatus for an electrophotographic copying apparatus.

In electrophotographic copying systems of various types, known image transfer type electrophotographic copying systems are roughly classified into a visible image transfer type in which electrostatic latent images are formed on the surface of a photoconductor and the electrostatic latent images are developed into visible images, which are then transferred to an image transfer material; and an electrostatic latent image transfer type in which the electrostatic latent images formed on the surface of a photoconductor are transferred to an electrostatic latent image transfer material and the transferred electrostatic latent images are developed to visible images.

In either of the above-mentioned image transfer type electrophotographic copying systems, the image transfer material is transported in uniform contact with the surface of a photoconductor and the process of separating such image transfer material from the photoconductor after the image transfer process is a very important process. Various types of image transfer material separation and transportation apparatus with the above-mentioned function has been proposed and provided for practical use.

Furthermore, various types of photoconductors are also known for use in the electrophotographic copying apparatuses of the image transfer type, for instance, drum-shaped photoconductors and belt-shaped photoconductors. Hereinafter, for the convenience of explanation, only an electrophotographic copying apparatus employing a drum-shaped photoconductor (hereinafter referred to as "photo-conductor drum") will be explained.

Around the photoconductor drum, there are arranged a charging apparatus, an exposure optical system, a development apparatus, an image transfer apparatus, a sheet separation and transportation apparatus, a cleaning apparatus, a charge quenching apparatus and other known devices. The photoconductor drum is rotated in a predetermined direction and a visible image is formed on the surface of the photoconductor drum after the processes of charging, exposure and development. When the visible image formed on the photoconductor drum comes to an image transfer section, an image transfer material is brought into close contact with the surface of the photoconductor drum in synchronization with the arrival of the visible image at the image transfer section, so that the visible image formed on the surface of the photoconductor drum is transferred to the image transfer material by the image transfer apparatus.

The image transfer material to which the visible image has been transferred is separated from the surface of the photoconductor drum. As mentioned previously, various transfer material separation method are known, for instance, a method of employing a pick-off pawl is known. In that method, the image transfer material is separated from the surface of the photoconductor drum by a pick-up pawl which is in contact with the peripheral surface of the photoconductor drum. This method has a shortcoming in that the pick-off pawl may scratch the surface of the photoconductor drum. In another known transfer material separation method, air is jetted between the image transfer material and the peripheral surface of the photoconductor drum to separate the image transfer material from the surface of the photoconductor drum. This method has shortcoming in that noise is produced by the air jet, and developer particles and dust are significantly scattered within the copying apparatus by the air jet. In a further known transfer material separation method, a pick-off belt is disposed on the peripheral surface of the photoconductor drum at one end thereof on the downstream side with respect to the rotating direction of the photoconductor drum. In this method, after image transfer, the image transfer material runs onto the pick-off belt as it is transported. The image transfer material which has run on the pick-off belt is guided in such a direction that the image transfer material is separated from the surface of the photoconductor drum by a guide member which is attached to part of the pick-off belt.

In the image transfer sheet separation and transportation apparatus employing the above-mentioned pick-off belt, the side edges of the image transfer section are formed in such a manner that the image transfer sheet can be separated beforehand from the surface of the photoconductor drum by the pick-off belt. Therefore, the image transfer sheets can be securely separated from the photoconductor drum. In this sense, this is one of the excellent image transfer sheet separation and transportation apparatuses. However, that apparatus has an unavoidable drawback in that the image transfer cannot be done throughout the whole area including the longitudinal side portion of the image transfer sheet.

This drawback is unavoidable in the pick-off belt transfer material separation system, and when the image exists in the very side portion of the original document, part of the image in the side portion cannot be copied. Stated differently, the side edge portion is the so-called dead space, which is a big obstacle to increasing the effective image area on the photoconductor.

SUMMARY OF THE INVENTION

It is therefore an object of the present invention to provide an image transfer material separation and transportation apparatus employing a pick-off belt, which is capable of guaranteeing the same separation function as that of the conventional image transfer material separation and transportation apparatus of the same type and, at the same time, capable of providing the maximum effective image area.

In order to attain the above-mentioned object, an embodiment of an image transfer material separation and transportation apparatus according to the invention comprises a photoconductor for forming an electrostatic latent image or a visible image thereon which is transferred to an image transfer material; a corner bending apparatus for bending only a leading edge corner of an image transfer material in the direction of separating the image transfer material from the surface of the photoconductor; an image transfer material catching and separation apparatus for catching the leading edge corner of the image transfer material which is bent so as to be away from the surface of the photoconductor and separating the image transfer material from the surface of the photoconductor when the image transfer material is moved except for the bent edge corner, together with the photoconductor in uniformly close contact therewith after image transfer; and an image transfer material transportation apparatus having rotating members which rotate at a peripheral speed substantially in synchronization with the peripheral speed of the photoconductor, holding the side portion of image transfer material on the side of the bent corner, separated from the surface of the photoconductor between the rotating members and moving the image transfer material in the direction opposite the rotating direction of the photoconductor, while separating the image transfer material from the surface of the photoconductor.

According to the invention, since one leading edge corner of the image transfer material is turned in the direction away from the surface of the photoconductor, and the image transfer material is separated from the surface of the photoconductor, while catching the bent corner thereof, the whole area except the bent corner of the image transfer material can be used as the effective image area. Furthermore, the pressure of the image transfer material catching and separation apparatus, such a pick-off pawl, against the surface of the photoconductor can be reduced in comparison with that of a conventional image transfer material catching and separation apparatus. Therefore, it can be prevented that the surface of the photoconductor is scratched or damaged.

Another object of the invention is to provide an image transfer material separation and transportation apparatus of the type described capable of preventing the skew of the image transfer material in the course of the transportation thereof by improving the corner bending apparatus.

This object can be attained by an image transfer material separation and transportation apparatus comprising a rotation roller provided with a blade on the peripheral surface thereof, for turning a leading edge portion of the image transfer material; an elastic roller into the peripheral surface of which the blade is pressed through the image transfer material so as to bend the leading edge side of the image transfer material upwards in collaboration with the above-mentioned rotation roller; image transfer material feeding means for bringing the leading edge portion of the image transfer material into the contact area of the above-mentioned two rollers or in close proximity to the two rollers from a set position of the image transfer material; a clutch mechanism for rotating the rotation roller and the elastic roller, which clutch mechanism normally stops the rotation roller by retracting the blade to a position where the image transfer material is not prevented from entering between the two rollers, and rotates the rotation roller to the position where the blade comes to the contact portion of the two rollers or in close proximity thereto from its retracted position prior to the operation of bending the leading edge of the image transfer sheet, thereby starting the corner bending operation; and a drive shaft which is connected to the clutch mechanism to drive the clutch mechanism.

By the image transfer separation and transportation apparatus mentioned above, the image transfer material can be fed in the direction of the photoconductor without being skewed, with one leading edge corner bent.

The clutch mechanism is a spring clutch which comprises a spring whose one end is attached to at least a large diameter portion of the drive shaft having the larger diameter portion and a small diameter portion connected to each other, which drive shaft is rotated in the transportation direction of the image transfer material; a rotation roller to which the other end of the spring is fixed, and a stopping and releasing means for stopping and releasing the rotation of the rotation roller. This clutch mechanism is extremely simple in construction and can attain the desired function.

A further object of the invention is to provide an image transfer material separation and transportation apparatus of the type described for use with an electrophotographic copying machine, which image transfer material separation and transportation apparatus is provided with an image transfer material transportation apparatus capable of separating the image transfer sheet from the surface of a photoconductor after image transfer and capable of transporting the image transfer sheet without bending a leading edge corner thereof completely, but straightening the same, when it is transported in the direction opposite the rotating direction of the photoconductor.

This object of the present invention can be attained by an image transfer material separation and transportation apparatus of the type described comprising a first rotating member which is disposed in close proximity to the photoconductor and is in contact with the back side of the image transfer material; a second rotating member which is rotated in contact with the first rotation member and also in contact with the front surface of the image transfer member and which is made of a material with a small coefficient of friction; a guide member for guiding the image transfer material to which the image has been transferred between the first rotating member and the second rotating member, the image transfer material being transferred in the direction opposite the rotating direction of the photoconductor with one side portion of the image transfer material held between the first rotating member and the second rotating member, and the surface of the first rotating member comprising a first area made of a member with a high coefficient of friction which is in contact with the back side of the image transfer material, and a second area made of a member with a low coefficient of friction which is in contact with the above-mentioned one side portion of the image transfer material, and a third area made of a member with a high coefficient of friction which is in contact with the second rotating member.

In the above-mentioned image transfer material separation and transportation apparatus, since a portion of the surface of the first rotating member which contacts with the side edge portion of the image transfer material is made of a member with a low coefficient of friction, if the image transfer material collides with that portion, it slips, so that the formation of a dog-ear in the image transfer material can be prevented. Furthermore, in the surface of the first rotating member, there are formed the first area which is in contact with the back side of the image transfer material, the third area which is in contact with the second rotating member, and these areas are made of materials with a high coefficient of friction. Therefore, the image transfer material can be separated from the surface of the photoconductor and can be transported without any slippage of the second rotating member. Therefore, the image formed on the surface of the image transfer material is not scratched immediately after the formation of the image.

BRIEF DESCRIPTION OF THE DRAWINGS

FIG. 27 is a side view of another image transfer material catching and separation member.

FIG. 28 is a side view of a further image transfer material catching and separation member.

FIG. 29 is a plan view of the image transfer material catching and separation member in FIG. 28.

FIG. 30 is a perspective view of the main portions of the image transfer material catching and separation member in FIG. 28.

FIG. 31 is a side view of a further example of an image transfer material transportation apparatus.

FIG. 32 is a plan view of the image transfer material transportation apparatus in FIG. 31.

DETAILED DESCRIPTION OF THE EMBODIMENT

Figure 1:
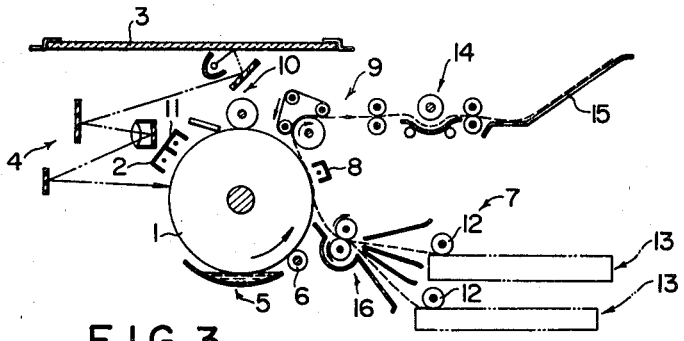
FIG. 1 is a diagrammatical view of an electrophotographic copying apparatus in which an image transfer material separation and transportation apparatus according to the invention is employed.

Referring to FIG. 1, there is shown diagrammatically an electrophotographic copying apparatus in which an embodiment of an image transfer material separation and transportation apparatus of the invention can be employed. In the electrophotographic copying apparatus shown in FIG. 1, a drum-shaped photoconductor is employed. However, a belt-shaped photoconductor can also be employed in the present invention. As the image transfer material, plain paper sheets which are cut in a predetermined size are employed. Therefore, hereinafter, the image transfer material is referred to as the image transfer sheet.

In FIG. 1, reference numberal 1 designates a photoconductor drum. The photoconductor drum 1 is rotated in the direction of the arrow. Around the photoconductor drum 1 there are arranged a charging appatatus for charging the surface of the photoconductor drum 1 to a predetermined polarity; an exposure optical system 4 for projecting the optical image of an original document (not shown) placed on a contact glass 3 to the electrically charged surface of the photoconductor drum 1, thereby forming an electrostatic latent image on the surface of the photoconductor drum 1; a development apparatus 5 for developing the electrostatic latent image to a visible image (a wet type development apparatus in FIG. 1); a squeegee roller 6 for regulating the thickness of a liquid developer remaining on the surface of the photoconductor drum 1 after development; a sheet feeding apparatus 7 for feeding image transfer sheets S individually to the surface of the photoconductor drum 1 on which the visible image is formed; an image transfer charger 8 for applying charges with a polarity opposite to that of the visible image to the back side of the tranfer sheet S which is in close contact with the surface of the photoconductor drum 1; a transfer sheet separation and transportation apparatus 9 for separating the transfer sheet S to which the visible image has been transferred from the surface of the photoconductor drum 1 and transporting the transfer sheet S in the direction opposite to the rotating direction of the photoconductor drum 1; a cleaning apparatus 10 for cleaning the surface of the photoconductor drum 1 after image transfer; and a charge quenching apparatus 11.

In the embodiment shown in FIG. 1, the sheet feeding apparatus 7 comprises two sheet feeding cassettes 13. Transfer sheets S are individually fed into the copying apparatus selectively from either of the two sheet feeding cassettes 13 by sheet feeding rollers 12. When the leading edge of the transfer sheet S which has been fed from the sheet feeding cassette 13 reaches a pair of registration rollers 16, the registration rollers 16 begin to be rotated, and, in accordance with the rotation of the registration rollers 16, the transfer sheet S is transported in the direction of the photoconductor drum 1 with the leading edge thereof directed to the surface of the photoconductor drum 1 so as to meet the leading edge of the visible image area on the photoconductor drum 1. Thereafter the transfer sheet S is moved together with the photoconductor drum 1 in contact with the surface thereof, so that the visible image is transferred from the surface of the photoconductor drum 1 to the transfer sheet S by the image transfer charger 8. After the image transfer, the transfer sheet S is guided in the direction away from the surface of the photoconductor drum 1 by a transfer sheet catching and separation member which will be described later and is then introduced into an image fixing apparatus 14 by the transfer sheet separation and transportation apparatus 9. Finally the transfer sheet S is discharged onto a copy tray 15.

Figure 2:
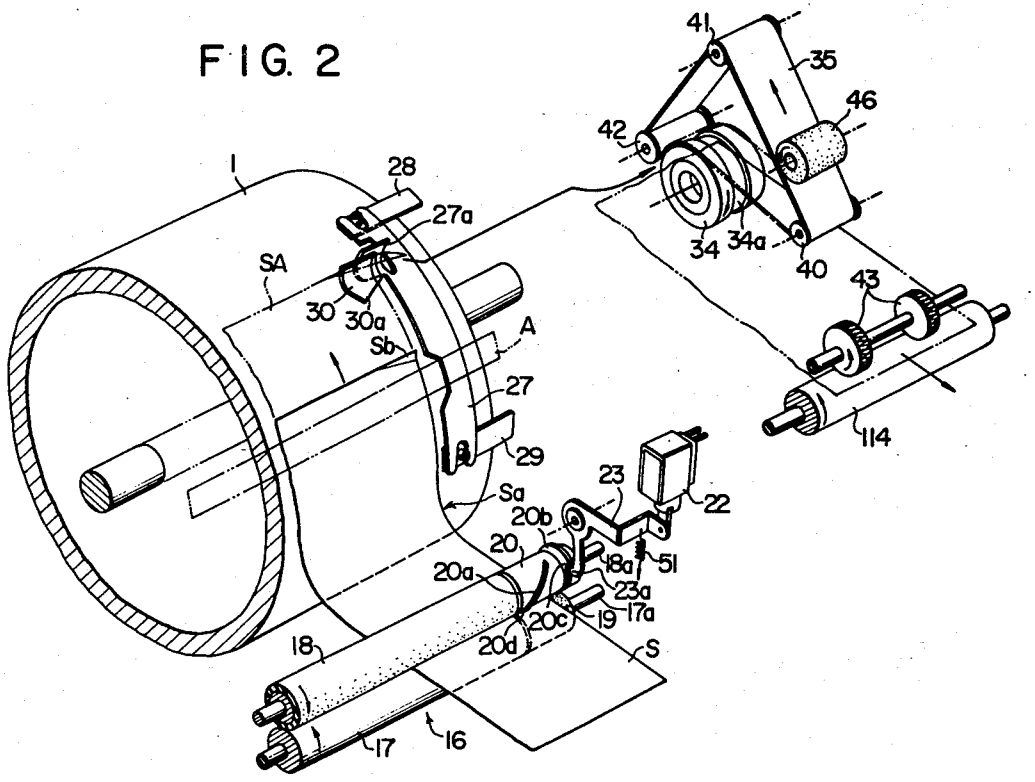
FIG. 2 is a perspective view of an embodiment of an image transfer material separation and transportation apparatus of the invention.
Figure 5:
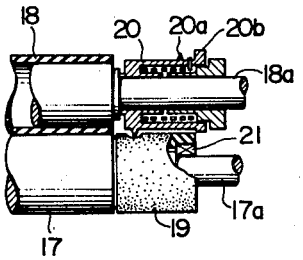
FIG. 5 is a cross-section view of the image transfer material corner bending apparatus in FIG. 4.

Referring to FIG. 2, the registration roller pair 16 for transporting the transfer sheet S in the direction of the photoconductor drum 1 while holding the transfer sheet S between the roller pair 16 comprises two rollers 17, 18. At one end of each of the rollers 17, 18, there are disposed an elastic roller 19 and a bent-blade roller 20. The elastic roller 19 is made of an elastic material, for instance, soft rubber or sponge rubber, and is rotatable through a bearing 21 relative to a shaft 17*a* to which the roller 17 is fixed as shown in FIG. 5. In other words, the elastic roller 19 is rotatable relative to a shaft 17*a*.

In the peripheral surface of the bent-blade roller 20, there is formed a spiral bent blade 20*a*. The bent-blade roller 20 serves to perform the function of a sleeve for a spring clutch mechanism. A stop projection 23*a* of a stop lever 23 which is connected to a solenoid 22 engages a step portion 20*c* formed in a flange 20*b* of the bent-blade roller 20.

The driving system for the rollers 17, 18 comprises a sprocket 24 of an input source, a gear 25 and a gear 26 and other members fixed to a shaft 18*a* of the roller 18, whereby the rollers 17, 18 are respectively rotated in the directions of the arrows.

A support blade 27 which is made of an elastic plate is disposed along the peripheral surface of the photoconductor drum 1 in one end portion thereof. One end of the support blade 27 is attached to a hanger bracket 28 and the other end of the support blade 27 is attached to a hanger bracket 29. A pick-off pawl 30 is fixed to the inside of a curved guide member 27*a* formed in the support blade 27. The pick-off pawl 30 is curved along the guide member 27*a*. As will be described later, the pick-off pawl 30 serves to pick off the transfer sheet S from the surface of the photoconductor drum 1 and is formed in a shape of a triangle one of whose vertexes serves as the pick-off operation portion. The vertex of the triangular pick-off pawl 30 is in light contact with or is positioned in close proximity to the surface of the photoconductor drum 1. The support blade 27 and the pick-off pawl 30 constitute an image transfer material catching and pick-off member.

Figure 6:
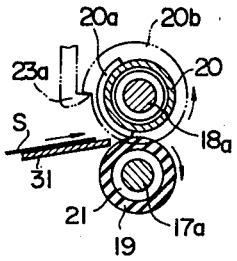
FIG. 6 is a section taken on line VI—VI in FIG. 5.
Figure 7:
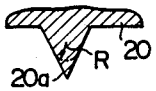
FIG. 7 is an enlarged sectional view of a bent blade.

Referring to FIG. 2, the transfer sheet S which is fed from one of the sheet feeding cassettes 13 (FIG. 1) is inserted between the rollers 17, 18 along a guide plate (FIG. 6) and is brought to a standby position. With a predetermined timing, the rollers 17, 18 begin to be rotated in the directions of the respective arrows by the driving system shown in FIG. 4. At the same time, the solenoid 22 is energized, whereby the stop lever 23 is rotated and the stop projection 23*a* releases the step portion 20*c* of the flange 20*b*.

As shown in FIG. 5, the bent-blade roller 20 is rotated in the same direction as that of the roller 18 by the so-called spring clutch function. At this moment, the bent-blade 20*a* is rotated while in pressure contact with the surface of the elastic roller 19 through the transfer sheet S. On the other hand, the elastic roller 19, which is not driven, is rotated, following the rotation of the bent-blade 20*a*.

Further at this moment, one corner of the transfer sheet S, which is directed to the photoconductor drum 1, is bent so as to be moved away from the surface of the photoconductor drum 1. More specifically, a portion Sb of the transfer sheet S is bent in the shape of a dog-ear. By the time the bent-blade roller 20 has made one revolution, the solenoid 22 has been deenergized. As a result, the stop lever 23 again stops the step portion 20*c*. Under this condition, the bent-blade roller 20 is stopped. In contrast to this, the rollers 17, 18 continuously rotate and the transfer sheet S having the dog-eared portion Sb is transported in the direction of the photoconductor drum 1.

The transfer sheet S is then moved together with the photoconductor drum 1 while in contact with the peripheral surface thereof and the visible image on the photoconductor drum 1 in its image transfer area A is transferred to the transfer sheet S. At this moment, the dog-eared portion Sb is in a position away from the surface of the photoconductor drum 1.

After the image transfer, the transfer sheet is continuously transported, so that the dog-eared position Sb passes over the pick-off end 30*a* of the pick-off pawl 30, and the remainder of the transfer sheet S which has been in close contact with the surface of the photoconductor drum 1 is separated from the surface of the photoconductor drum 1 by the pick-off end 30*a*. In other words, the pick-off pawl 30 picks up the dog-eared corner Sb of the transfer sheet S which is turned up and away from the surface of the photoconductor drum 1, separating the transfer sheet S from the surface of the photoconductor drum 1.

Thus, the embodiment of an image transfer material separation and transportation apparatus of the invention comprises essentially a transfer sheet corner turning apparatus including the bent-blade roller 20 provided with the bent blade 20*a*, and the elastic roller 19, and a transfer sheet catching and separation member, such as the pick-off pawl 30. In this embodiment, prior to image transfer, only a corner of the leading edge of the transfer sheet S is turned up by the transfer sheet corner turning apparatus so as to be away from the surface of the photoconductor drum 1, and, after image transfer, the turned up corner of the transfer sheet S is caught by the transfer sheet catching and separation member, so that the transfer sheet is separated from the surface of the photoconductor drum 1.

Therefore, in comparison with a conventional sheet separation apparatus employing a pick-off belt, the effective image area of the photoconductor drum 1 can be maximized. This is because, in the embodiment according to the invention, it is unnecessary to separate the entire side edge portion of the transfer sheet S in its longitudinal direction as in the conventional sheet separation apparatus. Furthermore, in the invention, the non-image transfer portion is limited to the leading edge corner of the transfer sheet S and is comparatively small in area. Therefore, it is possible to maximize the effective image area on the photoconductor drum 1. Furthermore, there is little possibility that images exist in the leading edge corner portion of the transfer sheet, so that the inconvenience in this regard is also minimized.

Further, in the case where the pick-off pawl 30 is employed as the transfer sheet catching and separation member, the transfer sheet can be securely picked off the surface of the photoconductor by disposing the pick-off end of the pick-off pawl 30 in extremely light contact with or in close proximity to the surface of the photoconductor drum 1, so that there is no risk that the pick-off pawl 30 may scratch the surface of the photoconductor drum 1.

In contrast to this, in the conventional sheet separation apparatuses, a single pick-off pawl is usually employed, so that it is required that the pick-off pawl be in pressure contact with the surface of a photoconductor and that the pick-off end of the pick-off pawl be sharpened. Therefore, there is a risk that the sharp pick-off end may scratch the surface of the photoconductor.

Figure 12:
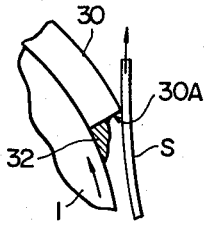
FIG. 12 is an enlarged side view of the image transfer material catching and separation member, particularly showing the action of an end portion of the member.

In the present invention, a pick-off end 30A can be made flat as shown in FIG. 12, so that a standing toner or developer 32 can be prevented from being in touch with the image surface of the transfer sheet S.

Figure 8:
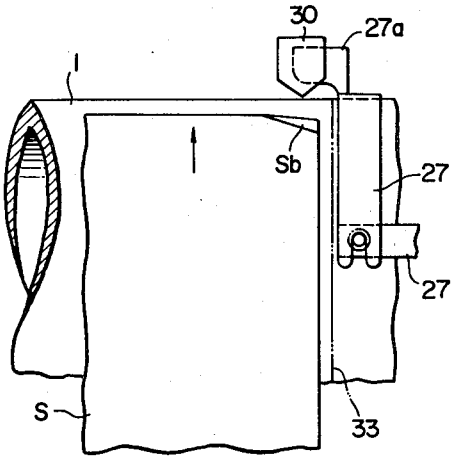
FIG. 8 is a front view of an image transfer material catching and separation member and an image transfer material, particularly showing their configuration.

Referring to FIG. 8, the imaginary line 33 indicates the boundary line between the photosensitive layer and the non-photosensitive layer of the photoconductor drum 1. That is, the left side with respect to the boundary line is the photosensitive layer portion, while the right side with respect to the boundary line is the non-photosensitive layer in FIG. 8. A support blade 27 for fixing the pick-off pawl 30 is disposed on the non-photosensitive layer side.

Further, in the above embodiment, a crease line is formed in the dog-eared position Sb as shown in FIG. 2. However, instead of doing so, the bent blade 20*a* can be rounded, without making it so sharp, so that the corner of the transfer sheet S can be curled so as to be away from the surface of the photoconductor drum 1. Thus, copies without such crease lines can be obtained.

As the transfer sheet catching and separation member, a sheet gripper for clamping the dog-eared portion of the transfer sheet S, which can be opened and closed, can also be employed. By forming the pick-off pawl 30 in the shape of a triangle whose vertex serves as the pick-off end 30*a*, it can be prevented that the toner or developer accumulates locally and the toner or developer is led to the opposite slanting edges of the transfer sheet S.

As shown in FIGS. 2 and 5, the elastic roller 19 is not driven, but it can be rotated freely, whereby the following function can be attained. When the roller 18 is a rubber roller, its counterpart roller 17 is made of metal. In contrast to this, since the elastic roller 19 is made of a soft rubber or sponge rubber, the coefficient of friction of the elastic roller 19 is greater than that of the metallic roller 17. Under this condition, when the leading edge of the transfer sheet S comes into contact with the roller 17 and the elastic roller 19 and is then inserted between the rollers 17, 18, a frictional resistance is generated between the leading edge of the transfer sheet S and the elastic roller 19. As a result, the leading edge corner of the transfer sheet S is delayed in the movement of the transfer sheet S, which may cause skewing of the transfer sheet S. However, since the elastic roller 19 is freely rotatable relative to the shaft 17*a* through the bearing 21, the elastic roller 19 is rotated by the above-mentioned frictional resistance, whereby the skewing of the transfer sheet S can be prevented.

The bent blade 20*a* is designed so as to slightly bite into the surface of the elastic roller 19. Therefore, the diameter of the bent blade 20*a* becomes greater than that of the elastic roller 19, so that the peripheral speed of the bent blade 20*a* is greater than that of the elastic roller 19.

When the roller 17 and the elastic roller 19 are made integrally, the bent blade 20*a* slips within the elastic roller 19 due to the difference in the peripheral speed between the elastic roller 19 and the bent blade 20*a*, so that there is a risk that the elastic roller 19 may be damaged. However, by designing the elastic roller 19 so as to be capable of rotating freely, the elastic roller 19 is rotated by the frictional resistance of the bent blade 20*a*. Thus, the slippage of the bent blade 20*a* does not take place and accordingly there is no risk of damaging the elastic roller 19.

Figure 9:
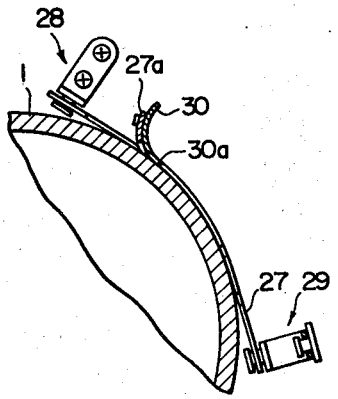
FIG. 9 is a side view of the image transfer material catching and separation member and a photoconductor drum, particularly showing their configuration.

Referring to FIG. 9, in the case of a system in which the pick-off end 30*a* of the pick-off pawl 30 is in light contact with the peripheral surface of the photoconductor drum 1 and the pick-off end 30*a* is brought into contact with the surface of the photoconductor drum only when sheet separation is performed, the abrasion of the photosensitive layer of the photoconductive drum 1 can be prevented more effectively than in the case where the pick-off end 30*a* is always in contact with the surface of the photoconductor drum 1.

Figure 10:
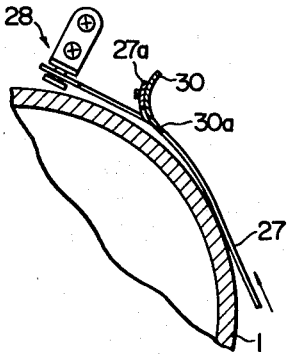
FIG. 10 is a side view of the image transfer material catching and separation member in operation in FIG. 9.

One end of the support blade 27 made of an elastic plate, on the side of a bracket 28, is swingably supported, and the other end of the support blade 27 on the side of a bracket 29 is free. The free end of the support blade 27 is pushed in the direction of the arrow as shown in FIG. 10 so as to be bent, and is then released, whereby the pick-off end 30*a* of the pick-off pawl 30 is made detachable from the surface of the photoconductor drum 1.

The above-mentioned detachable action is performed by use of some means, such as a cam, when the photoconductor drum 1 is detached or the image transfer charger 8 (FIG. 1) is detached or before and after image transfer. The same thing can be performed if the pick-off pawl 30 and the support blade 27 are made integrally.

The sheet feeding methods in electrophotographic copying apparatus can be roughly classified into two types. One type is of a one-side reference type and the other type is of a central reference type. In the one-side reference type sheet feeding method, sheets with different sizes are fed with one side edge of each sheet which is parallel to the sheet feeding direction thereof as a sheet feeding reference. Referring to FIG. 2, the above-mentioned one side of each sheet is located on the side of the elastic roller 19 and the bent-blade roller 20, so that sheets are transported by the rollers 17, 18. In this case, even if the sheets to be transported are different in size, the size of the dog-eared portion Sb of each sheet can be made constant.

Further in FIG. 2, as mentioned previously, the pick-off pawl 30 is for starting the sheet separation from the photoconductor drum 1. In this case, when the transfer sheet S begins to be separated from the surface of the photoconductor drum 1, starting from the dog-eared portion Sb to the remainder of the transfer sheet S, by the guide operation of the pick-off pawl 30, the transfer sheet S is turned in the direction opposite the rotating direction of the photoconductor drum 1 by a first sheet transportation rotating member, such as a turn roller 34, and by a second sheet transportation rotating member, such as a turn belt 35, with the transfer sheet S being held between the turn roller 34 and the turn belt 35, so that the sheet separation can be extended across the leading edge of the transfer sheet S. In other words, the transfer sheet S can be separated from the surface of the photoconductor drum 1, starting from the dog-eared portion Sb to the opposite corner of the transfer sheet S.

Figure 3:
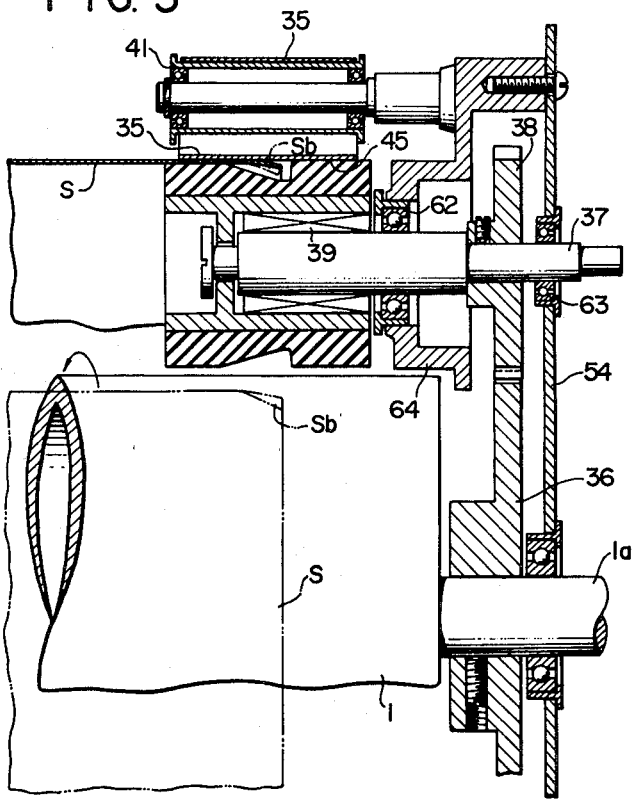
FIG. 3 is a cross-section of the image transfer material separation and transportation apparatus in FIG. 2.

The peripheral surface of the turn roller 34 is made of rubber, and the turn belt 35 which is in contact with the turn roller 34 is rotated, following the rotation of the turn roller 34. The turn roller 34 is rotated in synchronization with the rotation of the photoconductor drum 1. As shown in FIG. 3, a gear 36 is secured to a shaft 1*a* of the photoconductor drum 1, and the gear 36 is in engagement with a gear 38 which is secured to a shaft 37 of the turn roller 34.

Figure 11:
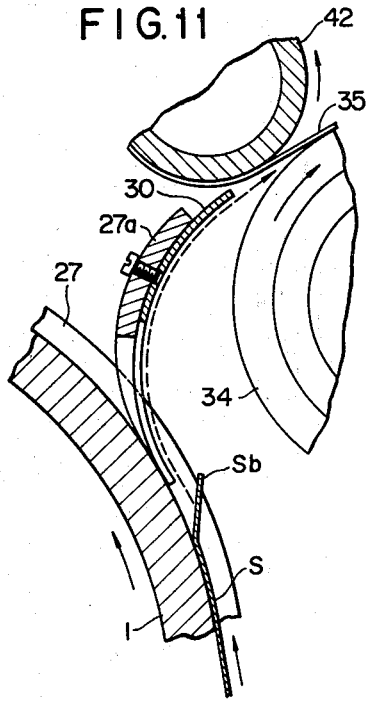
FIG. 11 is a partially enlarged sectional side view of an image transfer material which is being transported.

When the photoconductor drum 1 is rotated in the direction of the arrow, the turn toller 34 is rotated in synchronization with the rotation of the photoconductor drum 1, in the direction of the arrow in FIG. 2, through the gear 36, gear 38 and a one-way clutch 39. The turn belt 35 is trained over three belt pulleys 40, 41 and 42 and is rotated in the direction of the arrow. While the side portion on the side of the bent corner of the transfer sheet S is held between the thus constructed turn roller 34 and turn belt 35, the transfer sheet S is transported in the direction opposite the rotation of the photoconductor drum 1 and is then inserted between transfer rollers 43, 44. The transfer sheet S is then discharged onto the copy tray 15 via the image fixing apparatus as shown in FIG. 1. FIG. 11 shows an enlarged view of the step of the transfer sheet S being inserted between the turn roller 34 and the turn belt 35, while the transfer sheet S is separated from the surface of the photoconductor drum 1 by the pick-off pawl 30 and guided by the pick-off pawl 30.

Thus, by inserting the side portion of the transfer sheet S between the turn roller 34 and the turn belt 35 and transporting the same, the sheet separation can be extended across the leading edge of the transfer sheet S, and hereafter, the transfer sheet S can be successively separated from the surface of the photoconductor drum 1 in the rear direction of the transfer sheet S, the pick-off pawl 30 is not continuously brought into contact with the image area of the transfer sheet S and there is no risk that the image area of the transfer sheet S will be scratched by the pickoff pawl 30.

As shown in FIGS. 2 and 3, in a peripheral surface portion of the turn roller 34 where the dog-eared leading edge corner Sb of the sheet S passes over, a tapered circular groove 34*a* is formed, which constitutes room for the dog-eared portion Sb and, at the same time, which facilitates the insertion of the sheet S between the turn belt 35 and the turn roller 34.

Furthermore, when the turn roller 34 is mounted through the one-way clutch 39, if sheet jamming takes place, the jammed sheet can be removed easily by pulling the jammed sheet held between the turn roller 34 and the turn belt 35 in the direction opposite the sheet transportation direction, since the turn roller 34 and the turn belt 35 can be reversely rotated. In this embodiment, when sheet jamming occurs, the driving system is designed so as to be deenergized.

Referring to FIGS. 2 and 3, in this embodiment, when the sheet S is transported by the turn roller 34 and the turn belt 35, while held between them, the turn roller 34 and the turn belt 35 are partly in contact with each other, without through the sheets S, whereby the following advantages can be obtained:

The image area of the transfer sheet S comes into contact with the turn belt 35. Therefore, the turn belt 35 is made of a material having a high surface tension, such as teflon (trademark of DuPont for polytetrafluoroethylene), capable of preventing the offset of the image on the transfer sheet to the turn belt 35. The coefficient of friction of such a material is so small that if the transfer sheet S is present in the whole contact area between the turn roller 34 and the turn belt 35, the slippage takes place between the turn belt 35 and the sheet S. As a result, the image on the transfer sheet S is rubbed against the turn belt 35 or the turn belt 35 is stopped. This can be prevented in the course of sheet transportation by forming a mutual contact portion 45 as shown in FIG. 3 due to the friction of the mutual contact portion 45.

As shown in FIG. 2, dust or toner particles may be deposited on the surface of the turn belt 35. If such deposition takes place, the dust or toner particles adhere to the image area of the transfer sheet S or the sheet holding force of the turn roller 34 and the turn belt 35 may be weaker and slippage may occur between the roller 34 and belt 35.

Such a drawback can be eliminated by bringing a cleaning member, such as a cleaning roller 46, into contact with the surface of the turn belt 35 and cleaning the surface of the belt 35. As the cleaning member, a fur brush or a rubber blade can be employed.

Further, toner particles or a liquid developer may adhere to the surface of the roller 34. If such adhesion occurs, a cleaning member is brought into contact with the roller 34, too.

According to the present invention, the separation of the image transfer material is guaranteed and moreover substantially the whole area except the corner portion of the image transfer material can be used as the effective image area, maximizing the same. Furthermore, since the image transfer material catching and separation member, such as the pick-off pawl, is in extremely light contact with the surface of the photoconductor, the scratching and abrasion of the surface of the photoconductor can be prevented.

Figure 13:
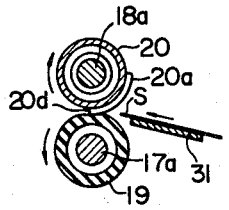
FIG. 13 is a sectional side view of an example of an image transfer material corner bending apparatus which is in the initial state.

When the transfer sheet S is fed from the sheet feeding apparatus (FIG. 1) into the registration roller pair 16, the bent-blade roller 20 and the elastic roller 19 are stopped at the position shown in FIG. 13. Under this condition, the operation start end 20*d* of the bent blade 20*a* (FIG. 2) is located on the line connecting the axes of the two registration rollers, that is, at the most closely contacting portion of the two rollers, whereby the operation start end 20*d* is set in conformity with the leading edge of the sheet S, so that one leading corner of the sheet S is securedly bent in a triangular form.

In such a corner bending apparatus, it may occur that when the leading edge of a sheet S is located at the operation start end 20*d*, the bent blade 20*a* becomes an obstacle to the insertion of the sheet S between the two rollers 19, 20, and if the sheet S is successively inserted between the two rollers 19, 20, the skewing of the sheet S is caused.

The present invention provides a solution to the above-mentioned problem by use of a particular clutch mechanism.

Figure 15:
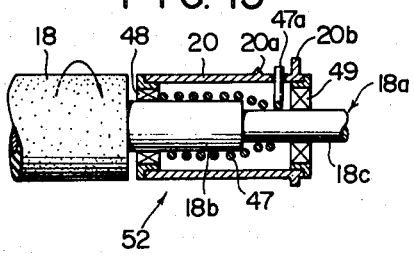
FIG. 15 is a front sectional view of a clutch mechanism.
Figure 17:
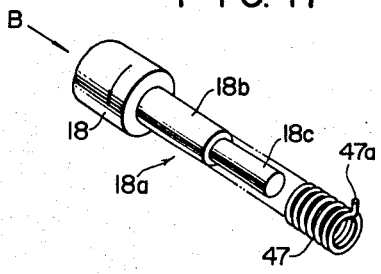
FIG. 17 is a perspective view of a drive shaft and a spring for the clutch mechanism in FIG. 15, particularly showing their assembling relationship.

The bent-blade roller 20 is attached to the shaft 18 through a spring clutch which is one example of the clutch mechanism. More specifically, referring to FIG. 15, a shaft 18*a* which serves as a drive shaft includes a large diameter portion 18*b* and a small diameter portion 18*c* connected to the larger diameter portion 18*b*. One end portion of a spring 47 shown in FIG. 17 is frictionally wound around the large diameter portion 18*b*, while the other end portion of the spring 47 is wound around the small diameter portion 18c as shown in FIG. 15. An end 47a of the spring 47 is fixed to the bent-blade roller 20. The bent-blade roller 20 is rotatably supported on the shaft 18a through a pair of bearings 48 and 49.

Figure 14:
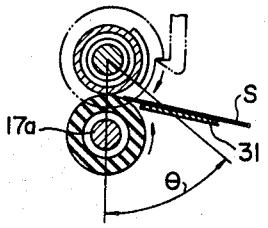
FIG. 14 is a sectional side view of another example of an image transfer material corner bending apparatus.

The bent blade 20a of the bent-blade roller 20 is normally at the position shown in FIG. 14. Under that condition, the leading edge of the transfer sheet S is inserted between the rollers 19, 20. At that moment, the sheet S is in a standby position. When the rollers 17 and 18 are rotated by a chain 50 (FIG. 4) in synchronization with the arrival of the leading edge of the image formation area on the photoconductor drum 1, the sheet S is fed towards the photoconductor drum 1. Simultaneously with or prior to the start of the rotation of the rollers 17, 18, the solenoid 22 is energized. When the solenoid 22 is energized, the stop lever 23 is rotated against the resilience of a spring 51 and the stop projection 23a releases the step portion 22c. Upon releasing the step portion 22c, the bent-blade roller 20 is rotated by an angle $\theta$ in the direction of arrow as shown in FIG. 14 by an action which will be described later. Under this condition, the operation start end 20d of the bent blade 20a is located at the position shown in FIG. 13 and the registration rollers 16 are rotated immediately, starting the feeding of the sheet S. The bent-blade roller 20 shown in FIG. 13 is also rotated in the direction of the arrow and a leading edge corner of the sheet is turned up in collaboration with the elastic roller 19.

Referring to FIG. 15, when the shaft 18a which serves as a drive shaft is rotated, the bent-blade roller 20 is released through a spring 47. As a result, the bent-blade roller 20 is rotated by the rotation transmission function of the spring clutch, that is, by the friction between the spring 47 and the large diameter portion 18b. While the bent-blade roller 20 is being rotated, the stop projection 23a of the stop lever 23 is brought into pressure contact with the peripheral surface of the flange 20b by the resilience of the spring 51. When the bent-blade roller 20 has made one revolution, the stop projection 23a engages the step portion 20c, whereby the rotation of the bent-blade roller 20 is stopped. During one revolution of the bent-blade roller 20, the leading edge corner of the transfer sheet is bent.

Figure 16:
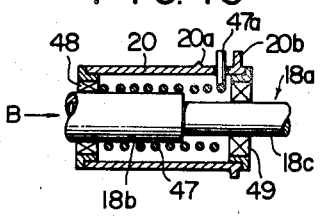
FIG. 16 is a front sectional view of the clutch mechanism in FIG. 15, which is in operation.

Referring to FIG. 15, when the bent-blade roller 20 is stopped as mentioned above, with the other end 47a of the spring 47 stopped, the registration rollers 16 are continuously being rotated and the spring 47 is urged in the winding direction thereof by the friction between the large diameter portion 18b and the spring 47, so that the spring 47 wound around the small diameter portion 18c is expanded as shown in FIG. 16, and from that moment on, the large diameter portion 18b begins to slip with respect to the spring 47. Under this condition, the bent-blade roller 20 is urged to rotate clockwise, that is, in the rotation direction of the shaft 18a, viewed from the arrow shown in FIG. 16. However, since the bent-blade roller 20 is stopped, it cannot be rotated and the elastic energy required for the spring 47 to be wound around the small diameter portion from the above-mentioned expanding state is stored in the spring 47.

When the solenoid 22 shown in FIG. 2 is energized, rotating the stop lever 23 and releasing the bent-blade roller 20, the bent-blade roller 20 shown in FIG. 16 is first rotated by an angle $\theta$ as shown in FIG. 14 by the above-mentioned stored resilience of the spring 47, and portion of the spring 47 around the small diameter portion 18c is wound around the small diameter portion 18c as shown in FIG. 15. The bent-blade roller 20 is then successively rotated through the spring 47 by the normal rotation transmission function of the spring clutch 52. Following the rotation of the bent-blade roller 20, the elastic roller 19 is also rotated and the leading edge corner is bent.

The spring 47 of the spring clutch is in the state as shown in FIG. 15 when it is incorporated in the copying machine. Once the operation of the copying machine is started, the spring 47 is brought to the position as shown in FIG. 16 at the initial stage of the operation. More specifically, when the shaft 18a begins to be rotated and the bent-blade roller 20 is stopped, the spring 47 around the small diameter portion 18c is in the expanded state. The previously mentioned rotation angle $\theta$ can be set as desired, depending upon the ratio of the diameter of the large diameter portion of the shaft 18a which serves as the drive shaft to that of the small diameter portion of the shaft 18a, and upon the winding number of turns of the spring 47 around the small diameter portion.

Since the spring 47 around the small diameter portion 18c is wound and unwound alternately, the small diameter portion 18c is not always necessary. However, by winding the spring 47 around the small diameter portion 18c, the rotation angle of the bent-blade roller 20 can be set more accurately. Alternatively, even if such a small diameter portion is provided, the spring 47 can be designed not to be wound around the small diameter portion when the spring is wound around the shaft 18a.

As mentioned previously, the bent-blade roller 20 shown in FIG. 16 is urged to rotate in the sheet transportation direction by the resilience stored in the spring 47 around the small diameter portion 18c and the rotation of the bent-blade roller 20 is prevented by the stop lever 23. If the registration rollers 16 are stopped under that condition, the shaft 18a tends to be reversely rotated, that is, counterclockwise, viewed from the arrow B, by the friction between the large diameter portion 18b and the spring 47 in FIG. 16 and by the above-mentioned stored resilience of the spring 47.

Figure 4:
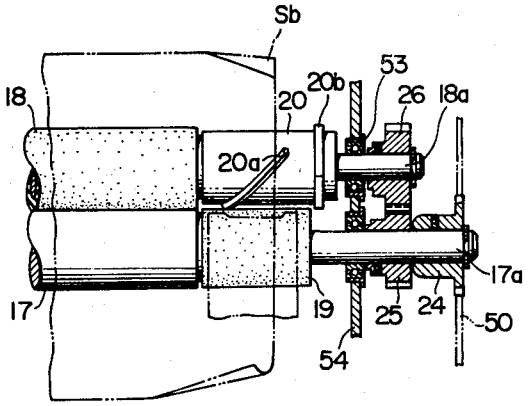
FIG. 4 is a partial front cross-section view of an image transfer material bending apparatus and a drive system therefor.

When this sort of the corner bending apparatus is operated, for example, by use of the sprocket 24, gears 25, 26, chain 50 and other members are shown in FIG. 4, the back-lash of the gears 25, 26 and the loosening of the chain 50 take place although they are extremely slight. Under this condition, if the shaft 18a is urged in the reverse rotation directiion, the back-lash of the gears and the loosening of the chain are absorbed, so that the shaft 18 is reversely rotated. If this takes place, the resilience stored in the spring 47 is freed to some extent and the initial rotation angle of the bent-blade roller 20 decreases, so that it becomes impossible to set the bent blade 20a at a predetermined position.

The reverse rotation of the shaft 18a can be prevented by providing a one-way clutch 53 at one end portion of the shaft 18a and supporting the shaft 18a by a side plate 54 through the one-way clutch 53. As the reverse rotation prevention means of this kind, a conventional reverse rotation prevention mechanism can be used instead of the one-way clutch.

In one-way clutch employed in the embodiment of the invention, the bent-blade roller 20 on the drive force input side is rotated with two steps, and a single energization of the solenoid 22 in accordance with an appropriate trigger pulse will do and therefore the control of the solenoid 22 is extremely simple.

According to the invention, in the leading edge corner bending apparatus, when the leading edge of the image transfer material such as the transfer sheet S, is inserted between the bent-blade roller 20 and the elastic roller 19, the bent blade 20*a* of the roller 20 is retracted from the sheet transportation path. Therefore, the insertion of the image transfer sheet S is not hindered by the bent blade 20*a* and furthermore, when the bending operation is started, the bent blade 20*a* of the roller 20 is properly positioned accurately between the roller 20 and the elastic roller 18. Therefore, the bending position of the leading edge corner of the image transfer material can be correctly set.

When the image transfer sheet S which has been separated from the surface of the photoconductor drum 1 is bitten between the turn belt 35 and the turn roller 34 in the course of the transportation of the image transfer sheet S, a leading edge corner of the sheet S is bent to form a dog-eared portion. Particularly, in the embodiment of the invention, in which the leading edge corner of the sheet S is bent and the sheet separation performance has been improved in comparison with the conventional sheet separation apparatus, the leading edge corner is completely bent to form the dog-eared portion. As mentioned previously, the possibility that images exist in the dog-eared portion is extremely small and it will be unnecessary to take into consideration the effect of the dog-eared portion on the image on the sheet S. However, it is not preferable that each copy sheet has such a dog-eared portion from the viewpoint of the copy quality. Therefore, in the embodiment shown in FIG. 2, the cylindrical groove 34*a* is formed in the peripheral surface of the turn roller 34 to allow the dog-eared portion of the image transfer sheet S to pass therethrough.

In the electrophotographic copying apparatus showing in FIG. 1, the sheet S transported by the sheet transportation apparatus is discharged onto the copy tray 15 via the image fixing apparatus 14 and the sheet S is transported by the sheet transportation means including several sheet transportation rollers while held between the rollers, so that if the bent edge corner of the sheet S is stopped by some of the sheet transportation rollers, the skewing of the sheet S may take place, causing the sheet jamming. In particular, the dog-eared portion of the sheet S may cause the formation of wrinkles throughout the sheet S in the copying machine employing a roller image fixing apparatus.

The formation of such a dog-eared portion can be prevented by making the surfaces of the turn roller 34 and the turn belt 35, with which the image transfer sheet S is in contact, of a material with a low coefficient of friction, so that the leading edge portion of the sheet S makes slippage when it collides with the surface of the turn roller 34 and the turn belt 35. However, if the turn roller 34 and turn belt 35 are constructed in the above-mentioned manner, the function of transporting the sheet S in the predetermined direction while holding the sheet S between the roller 34 and belt 35 is impaired.

Further in this case, since the belt 35 is rotated, following the rotation of the roller 34, the belt 35 makes a slippage, so that it becomes difficult to rotate the belt 35 in sychronization with the rotation of the roller 34.

In particular, in an electrophotographic copying apparatus of the type utilizing the image transfer sheet up to every side portion thereof as the effective image area, if the turnbelt 35 makes a slippage; the image transferred to the sheet is scratched and impaired immediately after the image transfer.

The present invention gives a solution to such a problem for forming the surface of the turn roller as will be explained below.

Figure 18:
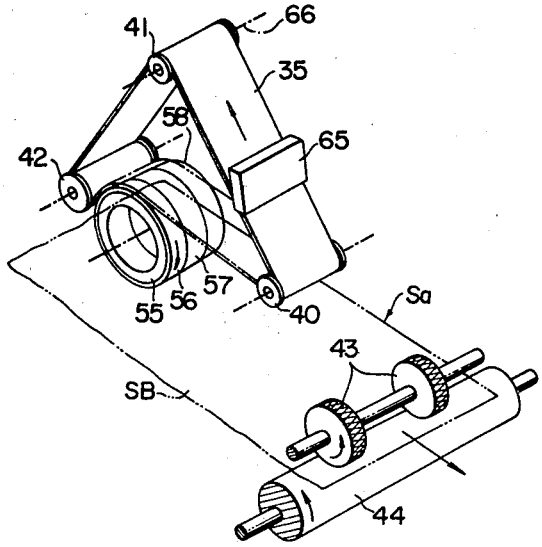
FIG. 18 is a perspective view of another example of an image transfer material transportation apparatus.
Figure 19:
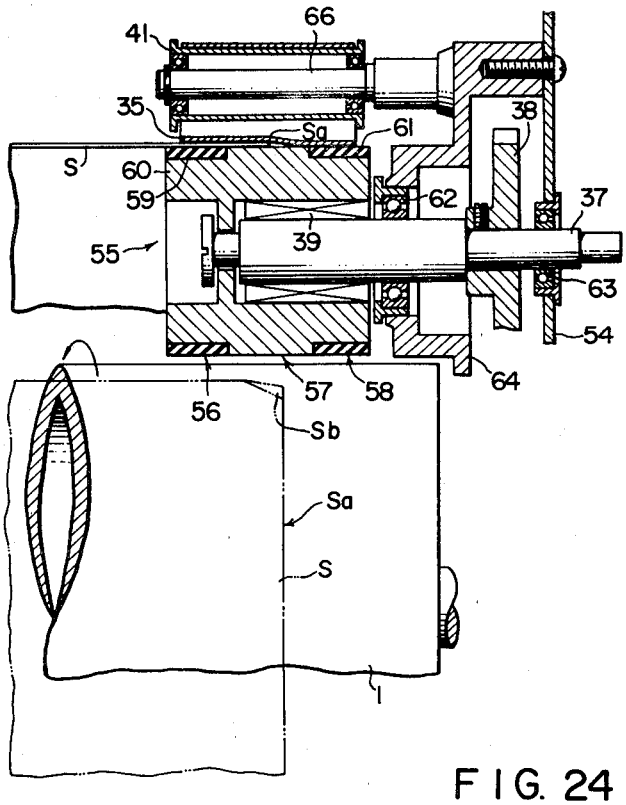
FIG. 19 is a front sectional view of the image transfer material transportation apparatus in FIG. 18.

Referring to FIG. 18, the surface of a turn roller 55 comprises three areas, the first area 56, the second area 57 and the third area 58. The first area 56 is located in such a position as to be in contact with the back side of the image transfer sheet S separated and transported as shown in FIG. 19. The first area 56 shown in FIG. 19 is made of a member 59 having a high coefficient of friction, such as rubber or a rubber-like material.

The second area shown in FIG. 19 is made of a metal 60 having a low coefficient of friction and is located at such a position to be in contact with the side portion Sa of the image transfer sheet S.

The third area 58 is made of a member 61 similar to that of the first area 56, such as rubber or a rubber-like material and is located at such a position to be in contact with the turn belt 35 which serves as a second rotating member as will be described later.

Stated differently, the turn roller 55 comprises a core roller made of the metal 60, with the opposite peripheral end portions thereof covered with the members 59 and 61 made of rubber or a rubber-like material, constituting the first and third areas with a high coefficient of friction and the second area in the central portion of the core roller, with a low coefficient of friction, in which the metal 60 is exposed. The core roller can be made of a synthetic resin.

The turn roller 55 is supported on the shaft 37 through the one-way clutch 39 as shown in FIG. 19 and is rotatable only in the direction so as to separate the image transfer sheet S from the surface of the photoconductor drum 1. The shaft 37 is rotatably supported by a bracket 64 and the fixed side plate 54 through bearings 62 and 63. The turn belt 35 is trained over the belt pulleys 40, 41 and 42, and the portion of the turn belt 35 between the belt pulleys 40 and 42 is in pressure contact with the turn roller 55 in such a manner as to be partly wound around the turn roller 55. Since the turn belt 35 comes into contact with the image transferred to the sheet S (the visible image in the case of this embodiment), toner may be transferred to the turn belt 35. Therefore, a blade 65 is in pressure contact with the surface of the turn belt 35 as a cleaning member for cleaning the surface of the turn belt 35. As the cleaning member, the cleaning roller 46 which rotates in the direction opposite the movement direction of the belt 35 can be employed. Alternatively, a polygonal prism can be employed as the cleaning member by bringing one surface thereof into pressure contact with the surface of the turn belt 35. Further, a cleaning member (not shown) can be brought into pressure contact with the surface of the turn roller 55.

The belt pulleys 40, 41 and 42 are rotatably supported by their shaft and are driven by the turn roller 55. In FIG. 19, in order to illustrate such arrangement, only a shaft 66 which supports the belt pulley 41 is shown.

In this case, the driving force for rotating the turn belt 35 is mainly transmitted from the third area 58 of the turn roller 55 when the image transfer sheet S is transported while held between the turn belt 35 and the turn roller 55.

When the photoconductor drum 1 is rotated in the direction of the arrow in FIG. 19, the turn roller 55 is rotated through the gear 38 and the one-way clutch 39, in synchronization with the rotation of the photoconductor drum 1.

The image transfer sheet S is moved as follows: The sheet S with the bent corner Sb which is formed by the bent blade 20a is separated from the surface of the photoconductor drum 1, with one side portion of the sheet S separated from the surface of the photoconductor drum 1 by the pick-off pawl 30 as indicated by SA in FIG. 2, after a a visible image has been transported to the sheet S from the image transfer area A of the drum 1, and the leading edge portion of the sheet S is guided between the turn roller 55 and the turn belt 35. When one side portion of the sheet S is held between the turn roller 55 and the turn belt 35, which are rotated in synchronization with the rotation of the drum 1, the sheet SB (FIG. 18) is turned in the direction opposite the rotating direction of the drum 1, so that the sheet SB is separated from the surface of the drum 1 in the direction across the width of the sheet SB and is then transported towards the transfer rollers 43, 44. The image transfer sheet SB is then transported in the direction of the imaging fixing apparatus 14 (FIG. 1) by the transfer rollers 43, 44. By transporting the sheet SB with one side thereof held between the turn roller 55 and the turn belt 35, the separation of the sheet SB can be extended in the direction across the width of the leading edge portion of sheet SB and thereafter the remainder of the sheet SB can be successively separated from the surface of the drum 1 towards the rear end of each sheet SB.

The bent portion Sb in the leading edge corner of the sheet SA which is picked off the surface of the drum 1 by the pick-off pawl 30 collides with the turn roller 55 or with the turn belt 35. In the conventional apparatus, the bent portion Sb is completely bent by the difference in peripheral speed between the turn roller and the turn belt, so that the so-called dog-eared portion is formed.

However, in the invention, the corner portion of the image transfer sheet Sb comes into contact with the second area 57 of the turn roller 55 and makes a slippage, so that the corner edge portion is inserted between the turn roller 55 and the turn belt 35 without being bent.

The bent portion Sb formed in one corner of the image transfer sheet is used only for separating the sheet from the surface of the photoconductor drum 1 and it is unnecessary for transporting the image transfer sheet. Therefore, it is preferable that such a bent portion be eliminated from the transfer sheet.

According to the present invention, one side portion of the image transfer sheet is held between the turn roller 55 and the turn belt 35, without forming such a dog-eared portion in the image transfer sheet. Therefore, if such a dog-eared portion is formed in the sheet, such a portion is straightened, whereby the sheet is transported in a stable manner.

As can be seen from FIG. 18, in the invention, the sheet SB separated and transported is held between the turn roller 55 and the first and second areas 56 and 57 of the turn roller 55. In other words, the sheet SB is securely transported since it is held between the first area with a high coefficient of friction and the turn belt 35. I appears that the turn belt 35 may slip on the surface of the sheet SB since the turn belt 35 is made of a member with a low coefficient of friction, but it does not slip since the turn belt 35 is in contact with the third area 58 with a high coefficient of friction of the turn roller 55. Therefore, the image transferred to the sheet SB is not scratched by the turn belt 35.

Figure 20:
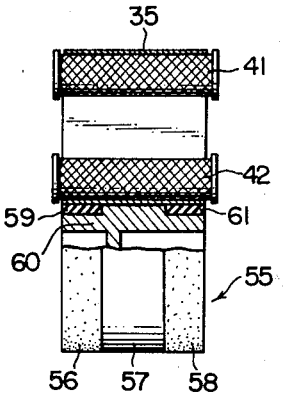
FIG. 20 is a front sectional view of the main portions of the image transfer material transportation apparatus in FIG. 18.

The turn roller 55 and the turn belt 35 shown in FIG. 18 are disposed in such a manner that the turn belt 35 is wound around the whole area of the turn roller 55 as shown in FIG. 20. In the case where the turn belt 35 is made of a member to which the toner image is difficult to be transferred from the image transfer sheet SB for preventing the offset of the toner image, it may be considered that the turn belt 35 makes a slippage on the third area 58 of the turn roller 55.

Figure 21:
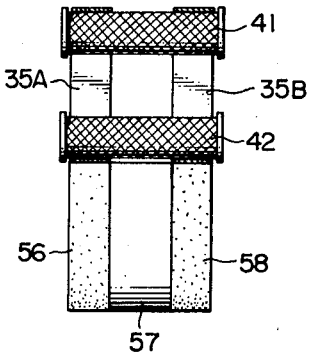
FIG. 21 is a front view of a second rotating member.

In order to prevent this, the turn belt 35 is divided into two portions 35A and 35B as shown in FIG. 21. In this case, the front surface of the turn belt portion 35A, that, the surface which contacts the sheet SB, is made of a member with a low coefficient of friction, while the back side of the turn belt portion 35A is made of a member with a high coefficient of friction. On the other hand, both sides of the turn belt portion 35B are made of a member with a high coefficient of friction. The turn belt portion 35A is in contact with the first area 56 of the turn roller 55 for holding the sheet SB between the turn belt 35A and the first area 56, while the turn belt portion 35B is in contact with the third area 58 of the turn roller 55. The surface of each of the belt pulleys over which the turn belt 35 is trained is treated not to make a slippage between the turn belt 35 and the belt pulleys. By thus constructing the turn belt portion 35B and the turn roller 55, the turn belt portion 35B and the turn roller 55 are rotated integrally without making any slippage between them, and the belt pulleys can securely transmit the rotation of the turn belt portion 35B to the turn belt portion 35A, so that the portion 35B and turn roller 55 can be rotated at the same speed, so that the surface of the image transfer sheet SB is not scratched. In the turn belt 35 shown in FIG. 21, the turn belt portion 35A can be in contact with the second area 57.

In the above-explained turn roller 55, the diameter of each area is the same. In order to straighten the bent corner Sb (FIG. 18), it is preferable that the diameter of each area in the turn roller 55 be the same. However, in order to prevent the bent corner Sb from being dog-eared, only the second area 57 can be made smaller in diameter than the other areas.

Figure 22:
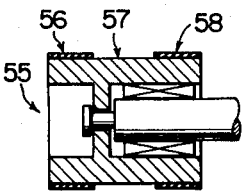
FIG. 22 is a front sectional view of a first rotating member.

An example of such a turn roller is shown in FIG. 22. The turn roller 55 in FIG. 22 comprises a second area 57 with a low coefficient of friction located in the central portion thereof, with the surface of the core metal roller exposed, and a first area 56 and a third area 58 with a high coefficient of friction on the opposite sides of the second area 57. In FIG. 22, the difference in the diameter between each area is exaggerated for illustration. Such a turn roller can be produced inexpensively.

Referring to FIG. 22, there is shown another type of a turn roller whose second area is made by coating a material with a much lower coefficient of friction, such as teflon. This kind of coating can be applied to the second area of the turn rollers shown in FIGS. 20 and 21 when the diameter of the second area is not larger than those of the first and third areas.

Figure 23:
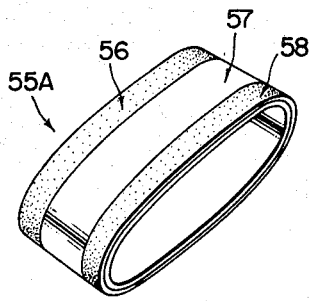
FIG. 23 is a perspective view of another example of a first rotating member.
Figure 24:
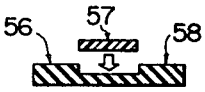
FIGS. 24 to 26 respectively show the end surfaces of other first rotating members, each having a first area, a second area and a third area.

The first rotating member employed in the invention is not limited to the above-mentioned turn roller 55, but an endless belt as shown in FIG. 23 can be employed. The first rotating member 55A of the endless belt type shown in FIG. 23 also comprises the first area 56, the second area 57 and third area 58 in the same manner as mentioned above. Several methods of forming each area will now be explained. In the first rotating member shown in FIG. 24, a material with a high coefficient of friction, such as rubber, is employed for making the base member of the belt to form the first area 56 and third area 58. A member with a low coefficient of friction such as a polyester film is applied to the central concave portion of the belt to form the second area.

Figure 25:
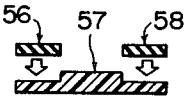

In the first rotating member shown in FIG. 25, for example, a polyester film is employed as the base member of the belt to form the second area, and rubber is applied on the opposite sides of the second area to form the first area 56 and the third area 58.

Figure 26:
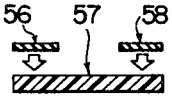

In the first rotating member shown in FIG. 26, for example, a polyester film is employed as the base member of the belt to form the second area, for example, rubber is coated on the opposite sides of the second area to form the first area 56 and the third area 58. In any of the abovementioned first rotating members, each area is at the same level or only the second area constitutes a cocave area. When the first rotating member is made of an endless belt, it is required that the endless belt do not make any slippage relative to its driving source. Further, in this case, as the support means for the endless belt, a plurality of conventional pulleys over which the endless belt is trained can be employed. When the first rotating member and the second rotating member are each constructed of an endless belt, the length of the side portion of image transfer sheet which can be held between the first and second rotating members can be set longer than in the case of turn rollers, so that the image transfer sheet can be more securely separated from the surface of the photoconductor.

A sheet pick-off pawl for separating sheets from the surface of the photoconductor drum 1, which is different from the aforementioned type sheet separation member, will now be explained.

Referring to FIG. 27, a sheet pick-off pawl 300 is formed in the shape of a cuneiform. The tip 100*c* of the sheet pick-off pawl 300, which is in contact with the surface of the photoconductor drum 1, is formed in a knife-edge shape. A surface 300*a* of the two sides of the tip portion 300*c*, on the side in contact with the surface of the drum 1, is made of a rubber layer 300*d* having a comparatively high coefficient of friction which is made of rubber or the like. The other surface 300*b* of the tip portion 300*c* is made of a material whose coefficient of friction is smaller than that of the rubber layer 300*d*. The surface 300*b* comes into contact with the image of the sheet and in order to form the surface 300*b* in the abovementioned conditions, the sheet pick-off pawl can be made of metal or hard plastic. When forming the rubber layer 300*d*, a thin rubber film is applied to the rubber layer 300*d*. Alternatively, the rubber layer 300*d* is coated by spraying a coating material or dipping in the same into a coating material.

In the above-mentioned sheet pick-off pawl, a sheet separation portion for separating each sheet from the surface of the drum 1 and a guide portion for guiding the separated sheet to a sheet transportation apparatus are integrally made.

The following example of a sheet separation pawl has different portions for performing the sheet separation function and sheet guiding function.

Referring to FIGS. 28 to 30, a sheet pick-off pawl 301 comprises a sheet separation portion 301*a* which contacts with the surface of the drum 1 and a sheet guide portion 301*b* for guiding the separated sheet to the image transfer material transportation apparatus. A surface of the sheet pick-off portion 301*a*, which is in contact with the surface of the drum 1, can be provided with a rubber layer 300*d* as mentioned in the aforementioned example of the sheet separation pawl. In FIG. 30, the thickness of the rubber layer 300*d* is exaggerated for illustration. The edge portion of the guide portion 301*b* is positioned slightly away from the surface of the drum 1. Sheet S advances together with the drum 1, and a bent portion Sb of the sheet S is scooped up by the sheet pick-up portion 301*a* and the sheet S is then guided by an extremely short distance. The guiding of the sheet S is then taken over by the guide portion 301*b* and is guided to the image transfer material transportation apparatus. When the sheet is transported by the image transfer material transportation apparatus, the image area of the sheet can be kept away from the sheet pick-off pawal by setting the transportation speed of the transportation apparatus greater than the movement speed of the photoconductor. Thus, the scratching of the image surface of the sheet by the sheet separation pawl can be prevented. Toner adheres to the sheet separation portion 301*a* which is in contact with the surface of the drum 1 when toner is scooped up from the surface of the drum 1. On the other hand, toner does not adhere to the sheet guide portion 301*b*. The sheet that has been separated from the surface of the drum 1 is guided by the sheet guide portion 301*b* and therefore is not smeared by toner.

The second rotating member in the present invention is not limited to the previously mentioned turn-belt 35. It can be a plurality of driven rollers which are driven in contact with the first rotating member. Referring to FIG. 31, three driven rollers 303, 304 and 305 are in contact with the outer peripheral surface of a roller 302 which serves as the first rotating member. On the outer peripheral surface of each of the three driven rollers, 303, 304, 305, there are formed numerous sharp projections. These projections are formed by conventional methods including knurling, thereby substantially reducing the contact area of the sheet with each of the driven rollers. Each of the driven rollers is independently rotatable and is supported on a shaft while urged in such a direction as to be brought into pressure contact with the drive roller 302.

Each of the driven rollers is disposed under the following conditions. Assume that the contact points of the driven rollers 303, 304, 305 with the drive roller 302 are respectively $P_1$, $P_2$ and $P_3$ and that the line connecting the contact point $P_1$ and the rotation center of the driven roller 304 is $l_1$. The angle between a tangent $l_2$ at the contact point $P_1$ and the line $l_1$ is $\theta_1$. When the line connecting the contact point $P_2$ and the rotation center of the driven roller 305 is $l_3$, the angle between the line $l_3$ and the tangent $l_4$ at the contact point $P_2$ is $\theta_2$. In other words, the extension line of the tangent $l_2$ at the contact point $P_1$ passes between the rotation center of the driven roller 304 and the contact point $P_2$. Likewise, the extension line of the tangent $l_4$ at the contact point $P_2$ passes between the rotation center of the driven roller 305 and the contact point $P_3$. Furthermore, as shown in FIG. 32, the driven rollers 303, 304, 305 are disposed out of alignment so that the contact portions of the respective driven rollers with the sheet do not overlap.

What is claimed is:

1. An image transfer material separation and transportation apparatus for an electrophotographic copying apparatus, which comprises:

a photoconductor for forming an electrostatic latent image or a visible image thereon, which is transferred to an image transfer material;

a corner bending means for bending only a leading edge corner of said image transfer material, said corner bending means including a bent-blade roller provided with a bent blade at the peripheral surface thereof for bending said edge corner, and a receiving roller having a peripheral surface into which said bent blade is pressed through said image transfer material when turning up said edge corner, and an image transfer material catching and separation apparatus for catching said edge corner after it has been bent so as to be away from the surface of said photoconductor and for separating said image transfer material from the surface of said photoconductor when said image transfer material is moved in uniformly close contact with said photoconductor, except for said leading edge corner, after image transfer to said image transfer material.

2. An image transfer material separation and transportation apparatus as in claim 1, wherein said corner bending means also comprises:

an image transfer material feeding means for feeding said image transfer material from a predetermined set position of said image transfer material to a position where the leading edge of said image transfer material is located at the contact portion of said bent-blade roller and said receiving roller or in close proximity to said two rollers;

a clutch mechanism for normally stopping said bent-blade roller, while retracting said bent blade of said bent-blade roller to a position where the insertion of said image transfer material between said bent-blade roller and said receiving roller is not hindered, and for rotating said bent-blade roller to a position where said bent blade comes to the contact portion of said bent-blade roller and said receiving roller or to a position in close proximity to said contact portion from the retracted position of said bent blade prior to the start of a corner bending operation of bending the leading edge corner of said image transfer material, and for rotating said bent-blade roller and said receiving roller in order to start said corner bending operation; and a drive shaft which is connected to said clutch mechanism.

3. An image transfer material separation and transportation apparatus as claimed in claim 2, wherein said bent blade is formed in a spiral shape on the peripheral surface of a roller member.

4. An image transfer material separation and transportation apparatus as claimed is claim 3, wherein said bent blade has an acute angle in cross section.

5. An image transfer material separation and transportation apparatus as claimed in claim 3, wherein said bent blade has a curvature in cross section.

6. An image transfer material separation and transportation apparatus as claimed in claim 2, wherein said clutch mechanism is a spring clutch, which comprises:

a spring wound around a drive shaft which is formed to have a large diameter portion and a small diameter portion connected to each other and which rotates in the direction of the transportation of said image transfer material, at least one end of said spring being fixed to said large diameter portion of the two portions of said drive shaft;

a sleeve at which the other end of said spring is stopped; and a release means for stopping and releasing said sleeve.

7. An image transfer material separation and transportation apparatus as claimed in claim 6, wherein said sleeve serves as a bent blade.

8. An image transfer material separation and transportation apparatus as claimed in claim 6, wherein said release means comprises a stop lever which is detachable from a stop portion of said sleeve, and a solenoid for swinging said stop lever.

9. An image transfer material separation and transportation apparatus as claimed in claim 2, wherein a drive shaft of said bent-blade roller is provided with a reverse rotation prevention means for preventing the reverse rotation of said shaft relative to said bent-blade roller.

10. An image transfer material separation and transportation apparatus as claimed in claim 2, wherein a drive shaft for driving said bent-blade roller constitutes a support shaft of a registration roller.

11. An image transfer material separation and transportation apparatus as claimed in claim 1, wherein said image transfer material catching and separation apparatus comprises a pick-off pawl whose pick-off operation end is located in extremely light contact with or in close proximity to the surface of said photoconductor.

12. An image transfer material separation and transportation apparatus as claimed in claim 11, wherein said pick-off pawl is in the shape of a triangle one of whose vertexes constitutes a pick-off operation end.

13. An image transfer material separation and transportation apparatus as claimed in claim 11, wherein said pick-off pawl is attached to a support blade made of an elastic plate which extends along the surface of said photoconductor, one end of said support blade being swingably mounted on a shaft, and the other end of said support blade being a free end, whereby said pick-off pawl is detachable from the surface of said photoconductor by moving said free end of said support blade in the direction of said first mentioned end of said support blade or by releasing said free end thereof.

14. An image transfer material separation and transportation apparatus as claimed in claim 13, wherein said support blade is disposed in the non-image formation area of said photoconductor, and said pick-off pawl is disposed on the line along which the bent leading edge of said image transfer material passes.

15. An image transfer material separation and transportation apparatus as in claim 1, wherein said image transfer material catching and separation apparatus comprises a sheet pick-off pawl including a sheet separation portion which is disposed parallel to the movement direction of the image transfer material while in contact with the surface of said photoconductor, and a guide portion for guiding said separated image transfer material, said sheet separation portion being capable of separating said image transfer material from the surface of said photoconductor prior to the guiding of said image transfer material by said guide portion, and said separated image transfer material being guided by said guide portion after being guided by said sheet separation portion for an extremely short distance.

16. An image transfer material separation and transportation apparatus as in claim 15, wherein said sheet pick-off pawl is provided with a rubber layer made of rubber whose hardness is less than 100° at a portion thereof in contact with the surface of said photoconductor.

17. An image transfer material separation and transportation apparatus as claimed in claim 15, wherein said sheet pick-off pawl includes a tip portion having an edge portion which is in contact with the surface of said photoconductor and which is disposed in the shape of a cuneiform towards the advancing image transfer material, one surface of said edge portion in contact with the surface of said photoconductor being made of an elastic material, while the other surface of said edge portion being made of a material having a coefficient of friction which is smaller than that of elastic material of the first mentioned surface of said edge portion.

18. An image transfer material separation and transportation apparatus as in claim 15, wherein said sheet pick-off pawl comprises a body member made of a hard plastic or a metal and a contact portion provided with a thin rubber layer which is in contact with the surface of said photoconductor, said rubber layer being formed by applying a thin rubber layer to said body member or by coating a rubber material on said body member by spraying the rubber material to said body member or dipping said body member in said rubber material.

19. An image transfer material separation and transportation apparatus as claimed in claim 1 wherein said bent-blade roller and said receiving roller are respectively disposed at the end portion of the shafts of a pair of registration rollers for transporting said image transfer material towards said photoconductor.

20. An image transfer material separation and transportation apparatus as claimed in claim 19, wherein said registration rollers are capable of feeding said image transfer material towards said photoconductor.

21. An image transfer material separation and transportation apparatus as claimed in claim 19, wherein said receiving roller is not driven by a rotation drive force, but is rotatable following the rotation of said bent-blade roller.

22. An image transfer material separation and transportation apparatus as claimed in claim 1 wherein said receiving roller has an elastic peripheral covering.

23. An image transfer material separation and transportation apparatus as claimed in claim 1 and further comprising a pair of registration rollers for transporting said image transfer material.

24. An image transfer material separation and transportation apparatus for an electrophotographic copying apparatus, which comprises:

a photoconductor for forming an electrostatic latent image or a visible image thereon, which is transferred to an image transfer material;

a corner bending apparatus including a bent blade roller carrying a bent blade on its peripheral surface for turning up and bending only a leading edge corner of said image transfer material;

an image transfer material catching and separation apparatus for catching said edge corner after it has been bent so as to be away from the surface of said photoconductor and for separating said image transfer material from the surface of said photoconductor when said image transfer material is moved in uniformly close contact with said photoconductor, except for said leading edge corner, after image transfer to said image transfer material; and an image transfer material transportation apparatus including a first rotating member which is rotated substantially at peripheral speed in synchronization with the movement of said photoconductor, in contact with said photoconductor, said first rotating member capable of holding the side portion of said image transfer material on the side of said leading edge corner thereof, which is separated from the surface of said photoconductor by said image transfer material catching and separation apparatus, and capable of transporting said image transfer material in the direction opposite the moving direction of said photoconductor, and said first rotating member being in contact with the back side of said image transfer material, and a second rotating member which is rotated in contact with said first rotating member and with the front side of said image transfer material.

25. An image transfer material separation and transportation apparatus as claimed in claim 24, wherein said corner bending apparatus comprises:

an elastic roller into the peripheral surface of which said bent blade is capable of being pressed through said image transfer material in order to turn up the leading edge of said image transfer material in collaboration with said bent-blade roller;

an image transfer material feeding means for feeding said image transfer material from a predetermined set position of said image transfer material to a position where the leading edge of said image transfer material is located at the contact portion of said bent-blade roller and said elastic roller or in close proximity to said two rollers;

a clutch mechanism for normally stopping said bent-blade roller, while retracting said bent blade of said bent-blade roller to a position where the insertion of said image transfer material between said bent-blade roller and said elastic roller is not hindered, and for rotating said bent-blade roller to a position where said bent blade comes to the contact portion of said bent-blade roller and said elastic roller or to a position in close proximity to said contact portion from the retracted position of said bent blade prior to the start of a corner bending operation of bending the leading edge corner of said image transfer material, and for rotating said bent-blade roller and said elastic roller in order to start said corner bending operation; and a drive shaft which is connected to said clutch mechanism.

26. An image transfer material separation and transportation apparatus as claimed in claim 25, wherein said bent-blade roller and said elastic roller are respectively disposed at the end portions of the shafts of a pair of registration rollers for transporting said image transfer material towards said photoconductor.

27. An image transfer material separation and transportation apparatus as claimed in claim 26, wherein said registration rollers are capable of feeding said image transfer material towards said photoconductor, utilizing an end portion on the side where said bent-blade roller and said elastic roller are disposed as one-side reference for feeding said image transfer material.

28. An image transfer material separation and transportation apparatus as claimed in claim 26, wherein said elastic roller is not driven by a rotation drive force, but is rotatable following the rotation of said bent-blade roller.

29. An image transfer material separation and transportation apparatus as claimed in claim 26, wherein said bent blade has an acute angle in cross section.

30. An image transfer material separation and transportation apparatus as claimed in claim 25, wherein said bent blade is formed in a spiral shape on the peripheral surface of a roller member.

31. An image transfer material separation and transportation apparatus as claimed in claim 30, wherein said bent blade has a curvature in cross section.

32. An image transfer material separation and transportation apparatus as claimed in clam 25, wherein said clutch mechanism is a spring clutch, which comprises:

a spring wound around a drive shaft which is formed to have a large diameter portion and a small diameter portion connected to each other and which rotates in the direction of the transportation of said image transfer material, at least one end of said spring being fixed to said large diameter portion of the two portions of said drive shaft;

a sleeve at which the other end of said spring is stopped; and a release means for stopping and releasing said sleeve.

33. An image transfer material separation and transportation apparatus as claimed in claim 32, wherein said sleeve serves as a bent blade.

34. An image transfer material separation and transportation apparatus as claimed in claim 32, wherein said release means comprises a stop lever which is detachable from a stop portion of said sleeve, and a solenoid for swinging said stop lever.

35. An image transfer material separation and transportation apparatus as claimed in claim 25, wherein a drive shaft of said bent-blade roller is provided with a reverse rotation prevention means for preventing the reverse rotation of said shaft relative to said bent-blade roller.

36. An image transfer material separation and transportation apparatus as claimed in claim 25, wherein a drive shaft for driving said bent-blade roller constitutes a support shaft of a registration roller.

37. An image transfer material separation and transportation apparatus as claimed in claim 24, wherein said image transfer material catching and separation apparatus comprises a pick-off pawl whose pick-off operation end is located in extremely light contact with or in close proximity to the surface of said photoconductor.

38. An image transfer material separation and transportation apparatus as claimed in claim 37, wherein said pick-off pawl is in the shape of a triangle of whose vertexes constitutes a pick-off operation end.

39. An image transfer material separation and transportation apparatus as claimed in claim 37, wherein said pick-off pawl is attached to a support blade made of an elastic plate which extends along the surface of said photoconductor, one end of said support blade being swingably mounted on a shaft, and the other end of said support blade being a free end, whereby said pick-off pawl is detachable from the surface of said photoconductor by moving said free end of said support blade in the direction of said first mentioned end of said support blades or by releasing said free end thereof.

40. An image transfer material separation and transportation apparatus as claimed in claim 39, wherein said support blade is disposed in the non-image formation area of said photoconductor, and said pick-off pawl is disposed on the line along which the bent leading edge of said image transfer material passes.

41. An image transfer material separation and transportation apparatus as in claim 37, wherein said pick-off pawl is provided with a rubber layer made of rubber whose hardness is less than 100° at a portion thereof in contact with the surface of said photoconductor.

42. An image transfer material separation and transportation apparatus as claimed in claim 37, wherein said pick-off pawl includes a tip portion having an edge portion which is in contact with the surface of said photoconductor and which is disposed in the shape of a cuneiform towards the advancing image transfer material, one surface of said edge portion in contact with the surface of said photoconductor being made of an elastic material, while the other surface of said edge portion being made of a material having a coefficient of friction which is smaller than that of said elastic material of the first mentioned surface of said edge portion.

43. An image transfer material separation and transportation apparatus as claimed in claim 37, wherein said pick-off pawl comprises a body member made of a hard plastic or a metal and a contact portion provided with a thin rubber layer which is in contact with the surface of said photoconductor, said rubber layer being formed by applying a thin rubber layer to said body member or by coating a rubber material on said body member by spraying the rubber material to said body member or dipping said body member in said rubber material.

44. An image transfer material separation and transportation apparatus as claimed in claim 24, wherein said first rotating member is a roller rotatable about the axis thereof which is parallel to the axis of said photoconductor.

45. An image transfer material separation and transportation apparatus as claimed in claim 44, wherein in said first rotating member roller, there is formed a circular groove for allowing the leading edge corner of said image transfer material to pass therethrough.

46. An image transfer material separation and transportation apparatus as claimed in claim 24, wherein said second rotating member is an endless belt.

47. An image transfer material separation and transportation apparatus as in claim 46, wherein said image transfer material catching and separation apparatus comprises a sheet pick-off pawl including a sheet separation portion which is disposed parallel to the movement direction of the image transfer material while in contact with the surface of said photoconductor, and a guide portion for guiding said separated image transfer material to said image transfer material transportation apparatus, said sheet separation portion being capable of separating said image transfer material from the surface of said photoconductor prior to the guiding of said image transfer material by said guide portion, and said separated image transfer material being guided by said guide portion after being guided by said sheet separation portion for an extremely short distance.

48. An image transfer material separation and transportation apparatus as claimed in claim 46, wherein said belt is in direct contact with said first rotating member.

49. An image transfer material separation and transportation apparatus as claimed in claim 46, wherein at least a surface portion of said belt, which comes into contact with said image transfer material, is made of a material capable of preventing image offsetting.

50. An image transfer material separation and transportation apparatus as claimed in claim 46, wherein said belt is provided with a cleaning member for cleaning a surface portion of said belt, which comes into contact with said image transfer material.

51. An image transfer material separation and transportation apparatus as claimed in claim 50, wherein said cleaning member is a cleaning blade which is in pressure contact with said belt.

52. An image transfer material separation and transportation apparatus as claimed in claim 50, wherein said cleaning member is a cleaning brush which is rotated in the direction opposite the movement direction of said belt in the contact area between said cleaning brush and said belt.

53. An image transfer material separation and transportation apparatus as claimed in claim 46, wherein said belt is trained over a plurality of belt pulleys and one portion of said belt is in contact with the peripheral surface of said first rotating member.

54. An image transfer material separation and transportation apparatus as claimed in claim 24, wherein the surface of said first rotating member comprises:

a first area comprising a member with a high coefficient of friction which comes into contact with the back side of said image transfer material;

a second area comprising a member with a low coefficient of friction which comes into contact with a side edge portion of said image transfer material; and a third area comprising a member with a high coefficient of friction which is in contact with said second rotating member.

55. An image transfer material separation and transportation apparatus as claimed in claim 54, wherein said first rotating member is a roller which rotates about the axis thereof, said axis being parallel to the rotating axis of said photoconductor.

56. An image transfer material separation and transportation apparatus as claimed in claim 54, wherein said three areas of said first rotating member are substantially the same in diameter.

57. An image transfer material separation and transportation apparatus as claimed in claim 54, wherein said first area and said third area of said first rotating member are the same in diameter, while the diameter of said second area is slightly smaller than that of said first and third areas.

58. An image transfer material separation and transportation apparatus as claimed in claim 54, wherein said second rotating member comprises two endless belts and one of said endless belts is in contact with said first area of said first rotating member while the other endless belt is in contact with said third area of said first rotating member.

59. An image transfer material separation and transportation apparatus as claimed in claim 58 wherein said two endless belts are trained over a plurality of belt pulleys, and the surface of at least one of said pulleys is treated in such a manner that no slippage takes place between said pulley and said belt.

60. An image transfer material separation and transportation apparatus as claimed in claim 54, wherein said first rotating member is an endless belt.

61. An image transfer material separation and transportation apparatus as claimed in claim 60, wherein said endless belt comprises a first area and a third area which are made of a base member with a high coefficient of friction, and a second area which is formed by applying a member with a low coefficient of friction to or coating the same on a concave portion formed in the peripheral direction in the central portion of said base.

62. An image transfer material separation and transportation apparatus as claimed in claim 60, wherein said endless belt comprises a second area which is made of a base member with a low coefficient of friction, and a first area and a third area which are formed by cutting the surfaces of said base on the opposite sides of said second area and by applying members with a high coefficient of friction to or coating the same on the cut surfaces.

63. An image transfer material separation and transportation apparatus as claimed in claim 60, wherein said endless belt comprises a second area which is made of a flat base member with a low coefficient of friction, and a first area and a third area which are formed by applying a member with a high coefficient of friction to or coating the same on the surfaces of said base member on the opposite sides of said second area in the direction along the peripheral surface of said base member.

64. An image transfer material separation and transportation apparatus as claimed in claim 54, wherein said first and second rotating members are constructed as one unit and are detachable from said image transfer material separation and transportation apparatus.

65. An image transfer material separation and transportation apparatus as claimed in claim 54, wherein the image transfer material transportation speed by said first rotating member is set so as to be slightly greater than the movement speed of said photoconductor and that of said image transfer material.

66. An image transfer material separation and transportation apparatus as claimed in claim 24, wherein said first rotating member is driven by gear means which is rotated substantially integrally with said photoconductor.

67. An image transfer material separation and transportation apparatus as claimed in claim 24, wherein a one-way clutch is disposed between said first rotating member and a drive source.

68. An image transfer material separation and transportation apparatus as claimed in claim 24, wherein at least a surface portion of said second rotating member which comes into contact with said image transfer material is made of a material with a low coefficient of friction.

69. An image transfer material separation and transportation apparatus as claimed in claim 24, wherein said second rotating member is in contact with said first rotating member and is rotated, following the rotation of said first rotating member.

70. An image transfer material separation and transportation apparatus as in claim 24 wherein said first rotating member is a drive roller whose outer peripheral surface is made of a material with a comparatively high coefficient of friction, and a plurality of driven rollers which serve as said second rotating member are in pressure contact with the outer peripheral surface of said drive roller with a predetermined pressure, in the outer peripheral surface of each of said driven rollers, there being formed numerous sharp projections and said driven rollers being disposed out of alignment.

71. An image transfer material separation and transportation apparatus as claimed in claim 70, wherein the tangent at the contact point between any of said plurality of driven rollers and said drive roller passes between the rotation center of the next driven roller downstream of said first mentioned driven roller with respect to the rotation of said drive roller and the contact point between the second mentioned driven roller and said drive roller.

* * * * *